US007637314B2

(12) United States Patent
Park et al.

(10) Patent No.: US 7,637,314 B2
(45) Date of Patent: Dec. 29, 2009

(54) HEAT EXCHANGER

(75) Inventors: Taeyoung Park, Daejeon-si (KR); Kwangheon Oh, Daejeon-si (KR); Duckho Lee, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 868 days.

(21) Appl. No.: 11/342,043

(22) Filed: Jan. 26, 2006

(65) Prior Publication Data

US 2006/0162917 A1 Jul. 27, 2006

(30) Foreign Application Priority Data

Jan. 27, 2005 (KR) ..... 10-2005-0007607

(51) Int. Cl.
*F28F 9/04* (2006.01)

(52) U.S. Cl. ..... 165/174; 165/175; 165/176

(58) Field of Classification Search ..... 165/173–176
See application file for complete search history.

(56) References Cited

U.S. PATENT DOCUMENTS 4,917,180 A * 4/1990 Wolf et al. ..... 165/150
5,172,761 A * 12/1992 Lyon ..... 165/173
5,295,532 A * 3/1994 Hughes ..... 165/76
6,749,015 B2 * 6/2004 Moreau ..... 165/174
6,827,139 B2 * 12/2004 Kawakubo et al. ..... 165/173
7,578,340 B2 * 8/2009 Forster et al. ..... 165/173
2004/0206490 A1 * 10/2004 Katoh et al. ..... 165/174
2005/0039901 A1 * 2/2005 Demuth et al. ..... 165/175

FOREIGN PATENT DOCUMENTS

JP 04353397 A * 12/1992
JP 2001141379 A * 5/2001
JP 2003-172592 12/2001
JP 2003-130584 5/2003
JP 2003-314987 11/2003

* cited by examiner

*Primary Examiner*—Allen J Flanigan
(74) *Attorney, Agent, or Firm*—Fulbright & Jaworski L.L.P.

(57) ABSTRACT

The present invention relates to a heat exchanger for carbon dioxide, in which a tank having a number of domes is coupled with a header and a connection member having a connection flow channel is interposed between the header and the tank, thereby easily changing a refrigerant flow channel, reducing the volume of a header tank, and improving productivity, pressure resistance and durability.

20 Claims, 11 Drawing Sheets

HEAT EXCHANGER

BACKGROUND OF THE INVENTION

1. Field of the Invention

This application claims priority from Korean Patent Application No: 2005-7607 filed Jan. 27, 2005 incorporated by reference in its entirety.

The present invention relates to a heat exchanger, and more particularly, to a heat exchanger for carbon dioxide, in which a tank having a number of domes is coupled with a header and a connection member having a connection flow channel is interposed between the header and the tank, thereby easily changing a refrigerant flow channel, reducing the volume of a header tank, and improving productivity, pressure resistance and durability.

2. Background Art

In general, a heat exchanger is installed on a flow channel of a cooling system or a heating system for cooling or heating a predetermined space by exchanging heat in such a way that heat exchange medium flowing inside the passageway sucks the outside heat or radiates its heat to the outside.

Such heat exchanger is classified into a condenser and an evaporator using refrigerant as heat exchange medium and a radiator and a heater core using cooling water as heat exchange medium according to its use purpose.

Referring to FIGS. 1 and 2, a conventional heat exchanger will be described in brief. As shown in the drawings, the heat exchanger 1 includes: a pair of header tanks 10 mounted at right and left sides thereof and spaced apart from each other at a predetermined interval; a number of tubes 20 each of which both end portions are connected to the header tanks 10 for communicating the two header tanks 10 with each other; heat radiation fins 30 interposed between the tubes 20 for promoting heat exchange by widening a heat transmission area; and side supports 40 mounted at the outermost portions of the tubes 20 and the heat radiation fins 30 for protecting them.

Here, each of the header tanks 10 includes a header 11 having a number of tube holes 13 for connecting both ends of the tubes 20, and a tank 12 coupled with the header 11 for forming a passage for flowing refrigerant therein.

Furthermore, baffles 60 are reciprocally mounted inside the header tanks 10 such that refrigerant flows through the tubes 20 in a zigzag form.

In the conventional heat exchanger 1, refrigerant flows into the header tank 10 through an inlet pipe 50. Refrigerant actively exchanges heat with the outside air while flowing through the tubes 20 in the zigzag form, and after that, is discharged through an outlet pipe 51.

Recently, a heat exchanger using carbon dioxide as refrigerant has been developed to solve the problem of global warming. Such carbon dioxide refrigerant is excellent in compression efficiency and in thermal transmission efficiency.

The heat exchanger for carbon dioxide has a structure similar with that of the conventional heat exchanger 1, but can endure high pressure due to an operational characteristic of carbon dioxide refrigerant.

For examples of the heat exchangers for carbon dioxide, Japanese Patent Publication No. 2003-314987 discloses a structure for flowing refrigerant through a hole formed on a side of a tube disposed between the external member and the internal member and through a communication passageway of a tank. Moreover, Japanese Patent Publication No. 2003-172592 discloses a structure for improving durability by forming a hole of the internal member smaller than the width of a tube to reduce the volume of a header, and Japanese patent Publication No. 2003-130584 discloses a structure for surrounding the outer surface of the heat exchanger with a brazing material.

However, such prior art heat exchangers are complicated in structure and deteriorated in productivity, or increase the volume of the header tank since it has the structure for surrounding the outer surface with the brazing material.

SUMMARY OF THE INVENTION

Accordingly, it is an object of the present invention to provide a heat exchanger, in which a tank having a number of domes is coupled with a header and a connection member having a connection flow channel is interposed between the header and the tank, thereby easily changing a refrigerant flow channel, reducing the volume of a header tank, and improving productivity, pressure resistance and durability.

To achieve the above object, according to the present invention, there is provided a heat exchanger comprising: upper and lower headers respectively having a number of tube insertion slots coupled with both end portions of a number of tubes arranged at intervals; upper and lower tanks respectively seated on the upper and lower headers and having domes respectively protruding in an insertion direction of the tubes, the domes have sections for surrounding an end portion of each tube in correspondence of the end portion of each tube; and upper and lower connection members respectively interposed between the headers and the tanks, and respectively having a number of insertion slots for inserting end portions of the tubes thereinto and connection flow channels for communicating the tubes with one another by connecting the insertion slots with one another.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Description of the same constitution and operation as the prior arts will be omitted.

Figure 1:
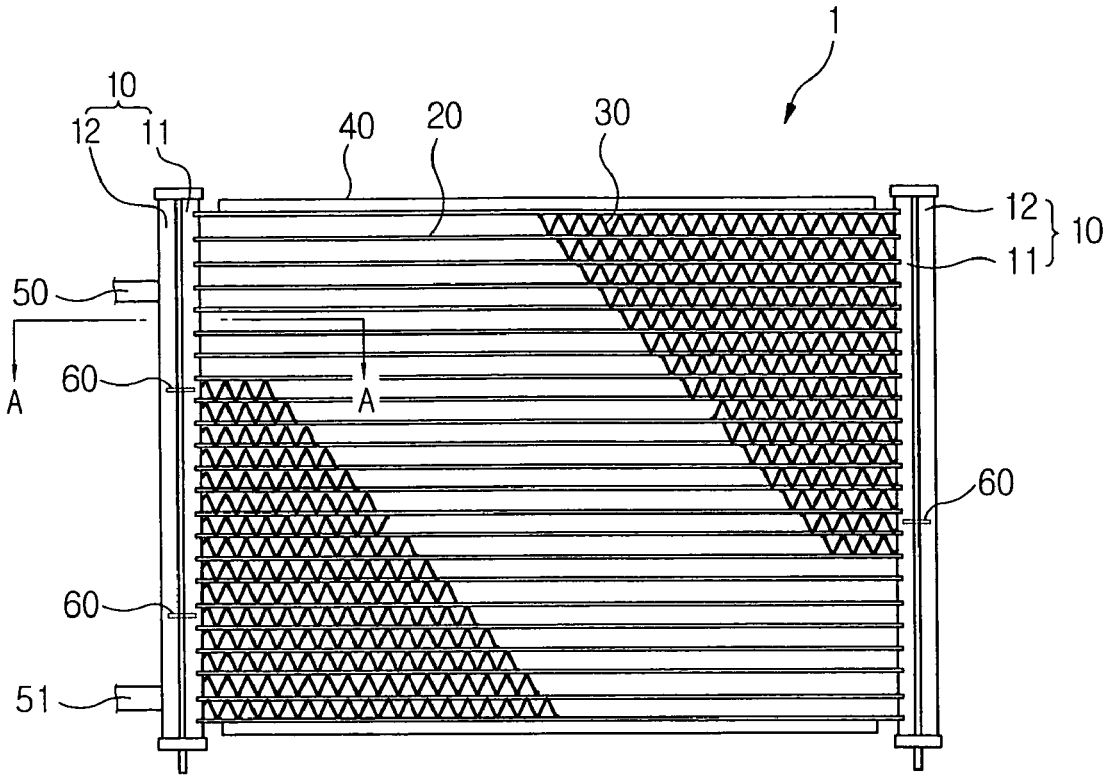
FIG. 1 is a front view of a conventional heat exchanger.
Figure 2:
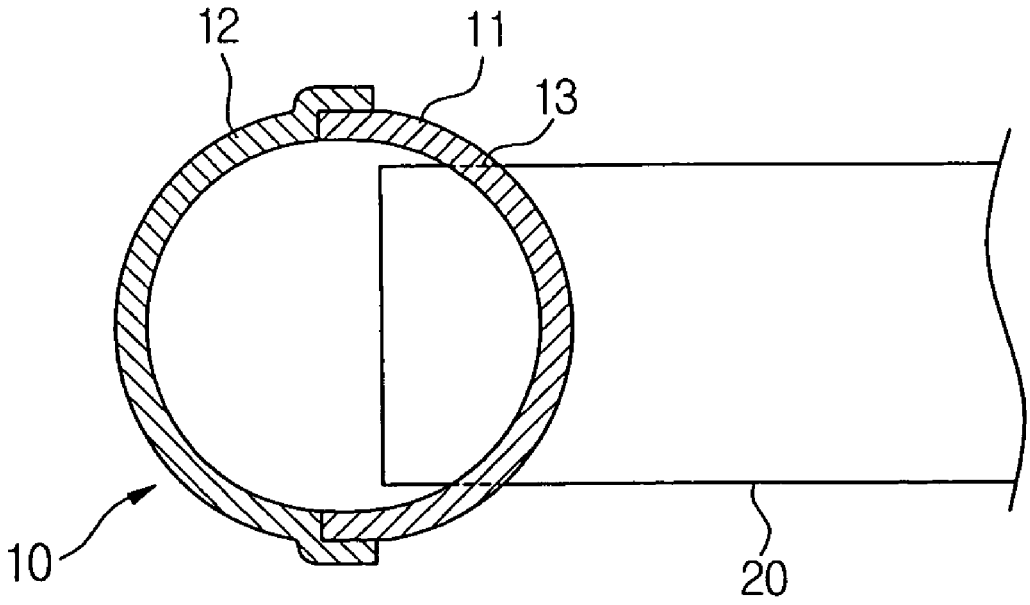
FIG. 2 is a sectional view taken along a line of A-A in FIG. 1.
Figure 3:
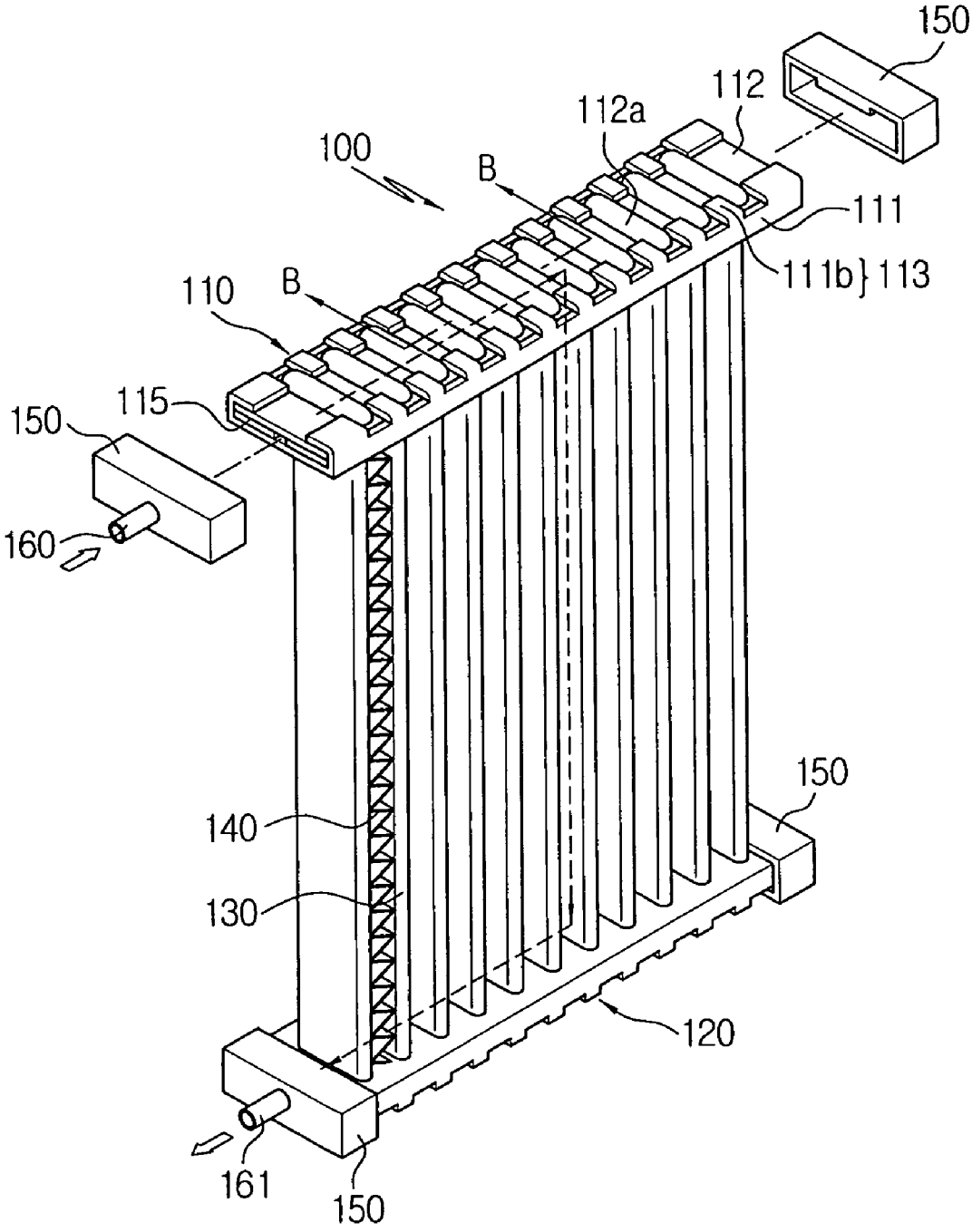
FIG. 3 is a perspective view of a heat exchanger according to a first preferred embodiment of the present invention.
Figure 4:
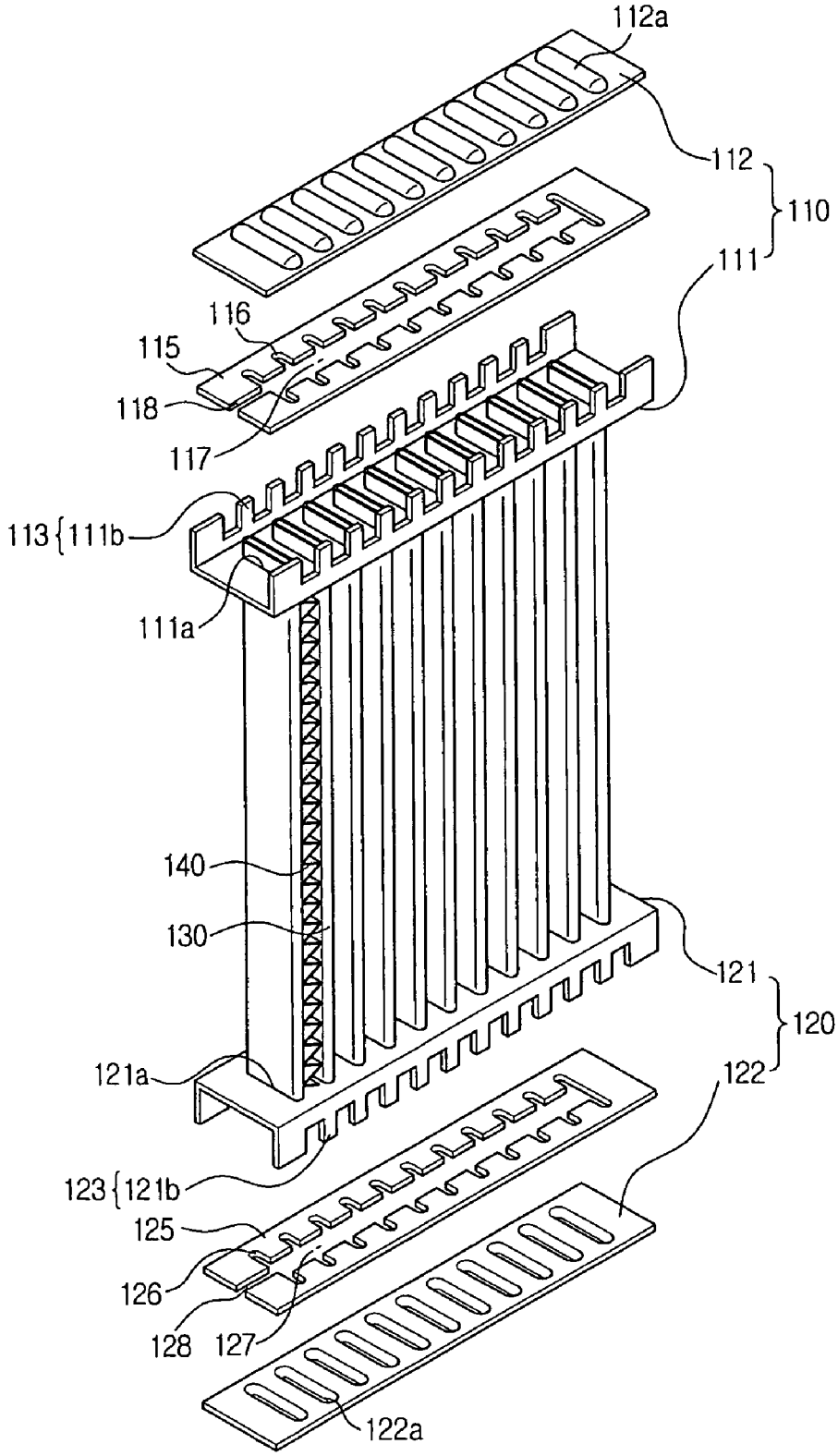
FIG. 4 is an exploded perspective view of the heat exchanger according to the first preferred embodiment of the present invention.
Figure 5:
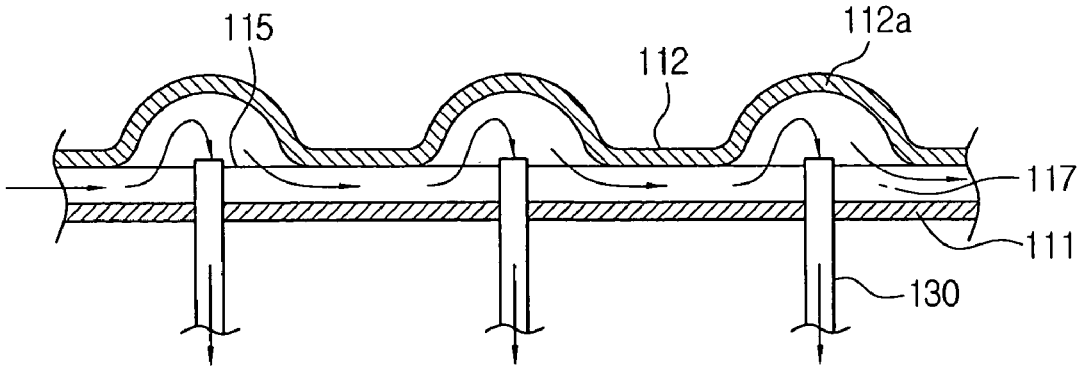
FIG. 5 is a sectional view taken along a line of B-B in FIG. 3.
Figure 6:
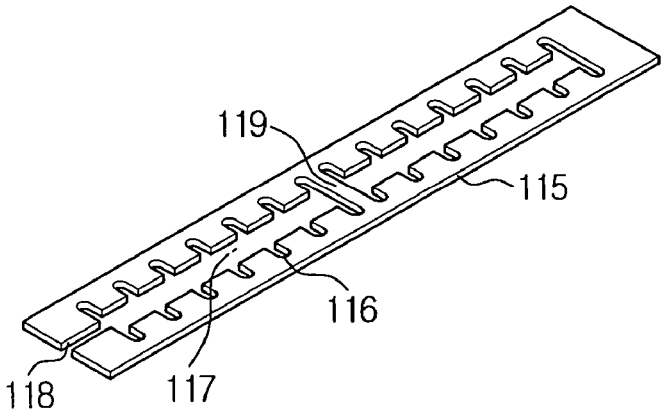
FIG. 6 is a perspective view showing a state where baffles are formed on a connection member in the heat exchanger according to the first preferred embodiment of the present invention.
Figure 7:
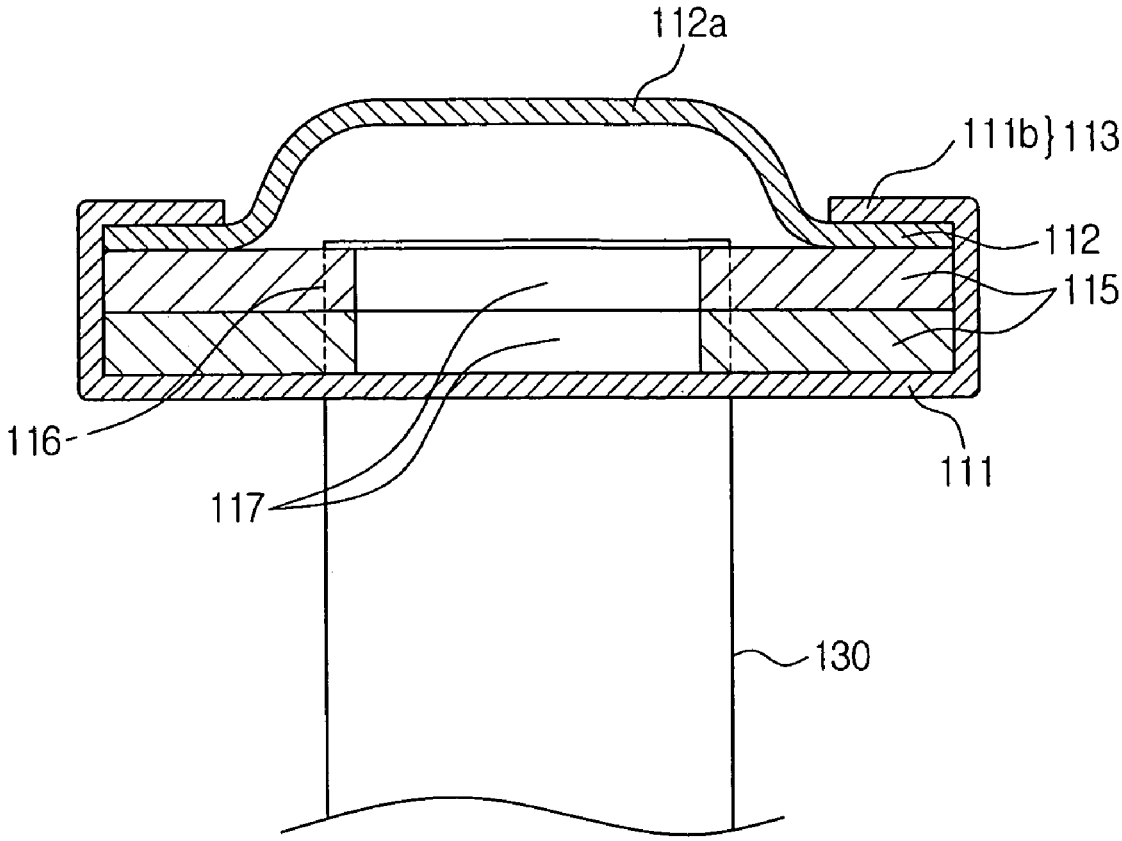
FIG. 7 is a sectional view showing a state where two connection members are vertically laminated in the heat exchanger according to the first preferred embodiment of the present invention.
Figure 8:
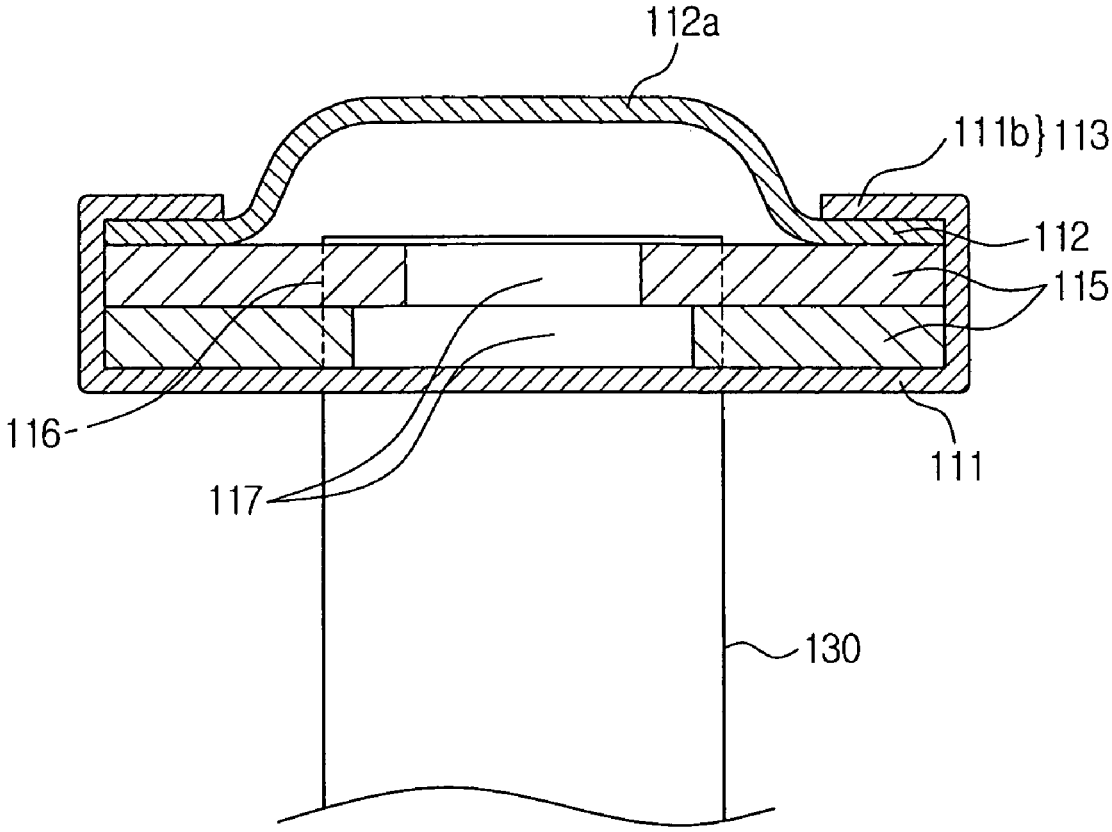
FIG. 8 is a sectional view showing another example of FIG. 7.

FIG. 3 is a perspective view of a heat exchanger according to a first preferred embodiment of the present invention, FIG. 4 is an exploded perspective view of the heat exchanger according to the first preferred embodiment of the present invention, FIG. 5 is a sectional view taken along a line of B-B in FIG. 3, FIG. 6 is a perspective view showing a state where baffles are formed on a connection member in the heat exchanger according to the first preferred embodiment of the present invention, FIG. 7 is a sectional view showing a state where two connection members are vertically laminated in the heat exchanger according to the first preferred embodiment of the present invention, and FIG. 8 is a sectional view showing another example of FIG. 7.

As shown in the drawings, the heat exchanger 100 according to the first preferred embodiment of the present invention includes upper and lower header tanks 110 and 120 respectively placed at the upper and lower portions of the heat exchanger 100, connection members 115 and 125, tubes 130, heat radiation fins 140, end caps 150, and inlet and outlet pipes 160 and 161.

First, the upper and lower header tanks 110 and 120 respectively include upper and lower headers 111 and 121, and upper and lower tanks 112 and 122 coupled to the upper and lower headers 111 and 121. The upper and lower headers 111 and 121 respectively include a number of tube insertion slots 111*a* and 121*a* for respectively inserting both ends of the plural tubes 130 arranged at intervals, and fixing means 113 and 123 disposed at both end portions thereof in the width direction thereof for fixing the upper and lower tanks 112 and 122.

Here, the fixing means 113 and 123 respectively include a number of protruding taps 111*b* and 121*b* formed in the length direction of the headers 111 and 121 for fixing both width-direction end portions of the tanks 112 and 122.

Therefore, the tanks 112 and 122 can be respectively fixed to the headers 111 and 121 while the protruding taps 111*b* and 121*b* are bent inwardly and compress the tanks 112 and 122 after the tanks 112 and 122 are seated on the headers 111 and 121.

Meanwhile, in stead of the protruding taps 111*b* and 121*b*, the fixing means 113 and 123 may have ribs (not shown) formed in the length direction of the headers 111 and 121 or be formed by bonding each component with braze.

Furthermore, the tanks 112 and 122 are respectively seated on the headers 111 and 121, and fixed by the protruding taps 111*b* and 121*b* or the ribs which are the fixing means 113 and 123. The tanks 112 and 122 respectively include a number of domes 112*a* and 122*a* protruding in a direction that the tubes 130 are inserted into the tube insertion slots 111*a* and 121*a*.

That is, the domes 112*a* and 122*a* respectively have sections for surrounding an end portion of each tube 130 in correspondence of the end portion of each tube 130, and are spaced from each other at the same intervals as the tubes 130. The inner periphery of each dome 112*a* or 122*a* is spaced from the end portion of each tube 130 at a predetermined interval. Therefore, the domes 112*a* and 122*a* can guide a smooth flow of refrigerant which flows into or out of the tubes 130.

Moreover, the connection members 115 and 125 are respectively interposed between the headers 111 and 121 and the tanks 112 and 122. The connection members 115 and 125 respectively include insertion slots 116 and 126 for inserting the end portions of the tubes 130 thereinto, and connection flow channels 117 and 127 for communicating the tubes 130 with one another by connecting the insertion slots 116 and 126.

The connection flow channels 117 and 127 are respectively intercommunicated with the inside of the domes 112*a* and 122*a* of the tanks 112 and 122 so as to intercommunicate the plural tubes 130.

Additionally, the connection members 115 and 125 may respectively have baffles 119 for closing specific portions of the connection flow channels 117 and 127 so that refrigerant flows through the tubes 130 in a zigzag form.

That is, the refrigerant flow channel of the heat exchanger can be formed in various shapes according to the existence of the baffles 119 or the position and the number of the baffles 119 in order to improve performance of an air-conditioning system.

Here, the baffles 119 can be formed only at the upper connection member 115 or at the upper and lower connection members 115 and 125, and in this case, it is preferable that the baffles 119 are formed reciprocally.

In addition, end caps 150 are coupled to both end portions of the upper and lower header tanks 110 and 120. The end cap 150 has an inlet pipe 160 for inducing refrigerant into the heat exchanger 100 and an outlet pipe 161 for discharging refrigerant completely heat-exchanged while flowing inside the heat exchanger 100.

Here, the positions of the inlet and outlet pipes 160 and 161 are determined according to the configuration of the refrigerant flow channel. That is, it is possible that the inlet pipe 160 is mounted at a side of the upper header tank 110 and the outlet pipe 161 is mounted at a side of the lower header tank 120, or that the inlet pipe 160 and the outlet pipe 161 are mounted at both sides of the upper header tank 110.

Therefore, it is preferable that an inlet flow channel 118 for communicating the inlet pipe 160 with the connection flow channel 117 and an outlet flow channel 128 for communicating the outlet pipe 161 with the connection flow channel 127 are selectively formed on end portions of the upper and lower connection members 115 and 125.

Meanwhile, as shown in FIGS. 7 and 8, a number of the connection members 115 (two connection members in the drawings) can be laminated between the header 111 and the tank 112.

That is, FIG. 7 shows a case where two connection members 115 of the same structure in which the insertion slots 116 and the connection flow channel 117 are formed are laminated. If the two connection members 115 are laminated, the connection flow channel 117 is extended so as to reduce a pressure drop rate of refrigerant.

FIG. 8 shows that the connection flow channels 117 formed on the laminated connection members 115 have different sizes. In this case, the volume of the connection flow channels 117 can be controlled according to where refrigerant is gathered too much, so that refrigerant distribution can be improved.

Furthermore, not shown in the drawings, but the connection member 115, which is in contact with the tank 112, of the laminated connection members 115 may have only the insertion slots 116 without the connection flow channel 117. In this case, the connection member 115 can improve pressure resistance and durability by increasing a contact area between the connection member 115 and the tank 112 while keeping the communication with the connection flow channel 117 of the other connection member 115 and the inside of the domes 112*a*.

Meanwhile, it is preferable that heat radiation fins 140 are interposed between the tubes 130 for promoting heat exchange by widening a heat transmission area.

Moreover, in the present invention, it is described that the end caps 150 are mounted at both end portions of the upper and lower header tanks 110 and 120, but the end caps 150 may be mounted only at positions where the inlet and outlet pipes 160 and 161 are mounted for flow-in and flow-out of refrigerant since the components (the headers, the connection members, and the tanks) of the header tanks 110 and 120 are in surface-contact with one another.

A refrigerant circulation process of the heat exchanger according to the first preferred embodiment of the present invention will be described as follows.

First, when refrigerant is supplied through the inlet pipe 160, refrigerant is induced into the connection flow channel 117 through the inlet flow channel 118 of the upper connection member 115. Here, when refrigerant is induced into the connection flow channel 117, refrigerant is supplied to the end portions of the tubes 130 through the plural domes 112*a* of the upper tank 112.

Continuously, refrigerant induced into the connection flow channel 117 flows along the tubes 130, and at this time, exchanges heat with the outside air passing through the tubes 130 during the process that refrigerant flows through the tubes 130. After that, refrigerant flows into the connection flow channel 127 of the lower connection member 125 through the domes 122*a* of the lower tank 122.

Refrigerant flown into the connection flow channel 127 of the lower connection member 125 passes through an outlet flow channel 128 formed at an end portion of the lower connection member 125, and is discharged through the outlet pipe 161 of the end cap 150.

Meanwhile, in the case where the baffles 119 are formed on the connection flow channel 127 of the connection member 125, the plural tubes 130 form a number of tube groups in which the tubes 130 are divided by a predetermined number by the baffles 119. Therefore, refrigerant induced through the inlet pipe 160 flows through the plural tube groups in the zigzag form by the baffles 119, and then, is discharged through the outlet pipe 161 to the outside.

Figure 9:
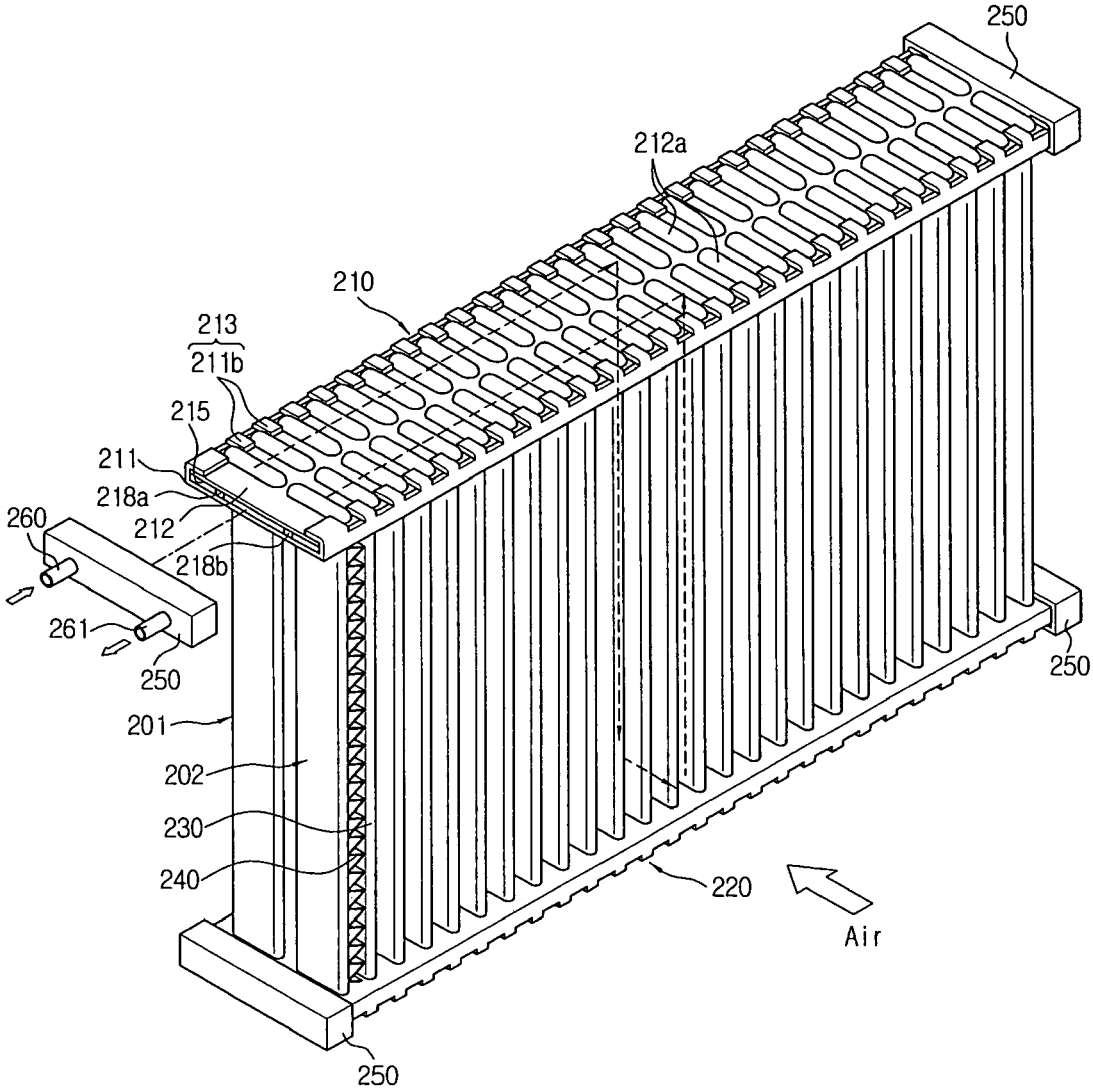
FIG. 9 is a perspective view of a heat exchanger according to a second preferred embodiment of the present invention.
Figure 10:
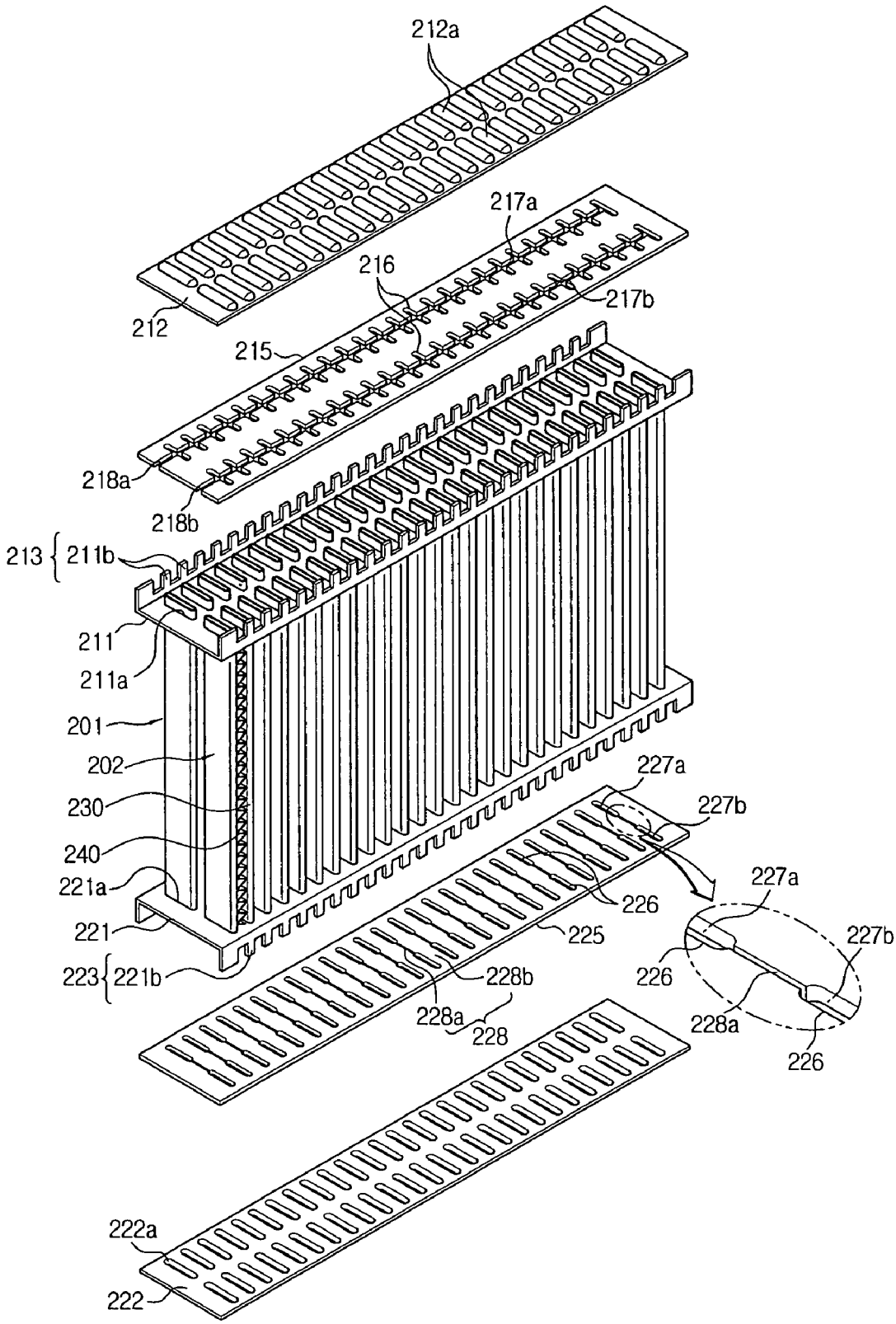
FIG. 10 is an exploded perspective view of the heat exchanger according to the second preferred embodiment of the present invention.
Figure 11:
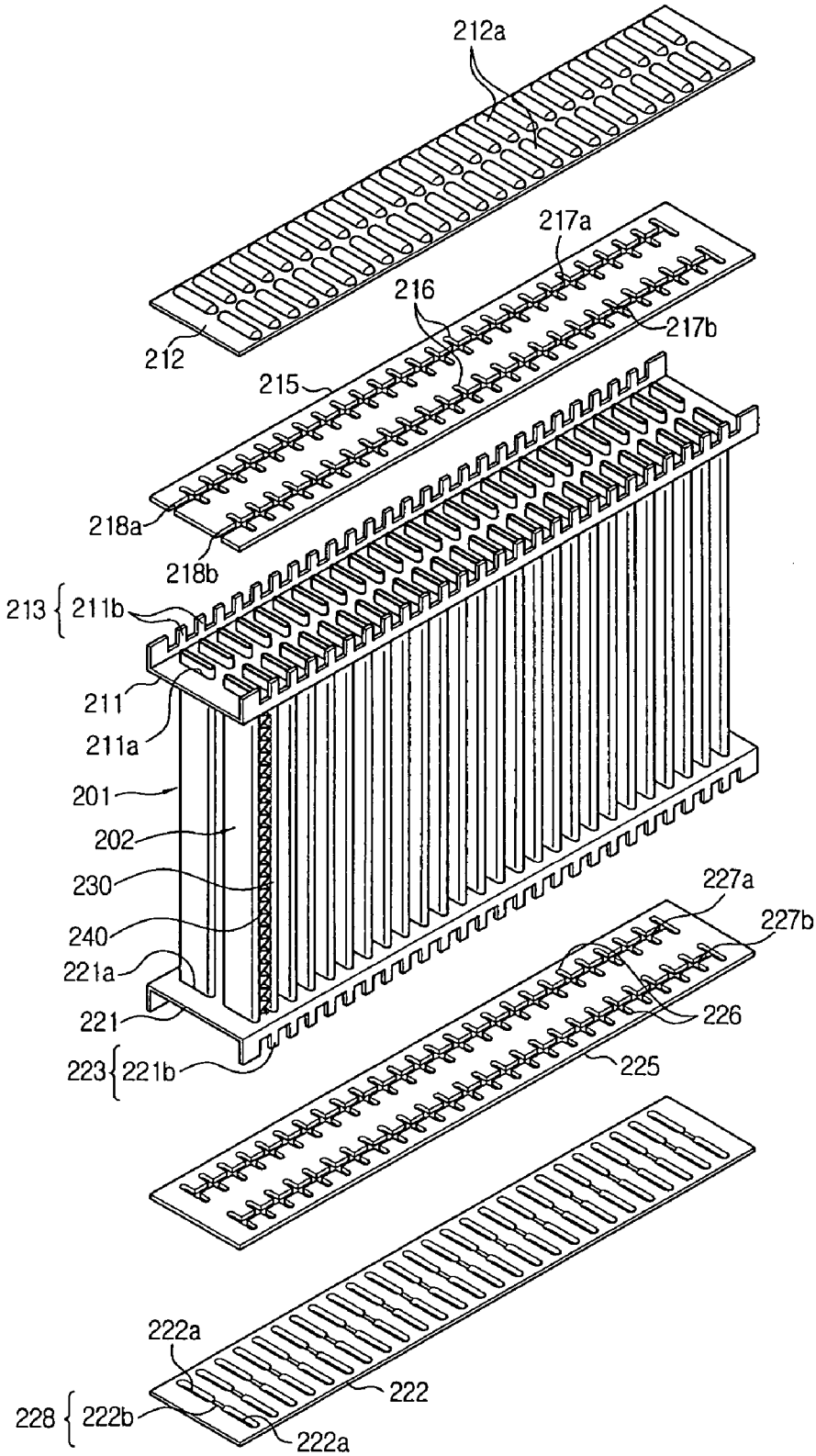
FIG. 11 is a perspective view showing a modification of communication means in the heat exchanger according to the second preferred embodiment of the present invention.

FIG. 9 is a perspective view of a heat exchanger according to a second preferred embodiment of the present invention, FIG. 10 is an exploded perspective view of the heat exchanger according to the second preferred embodiment of the present invention, and FIG. 11 is a perspective view showing a modification of communication means in the heat exchanger according to the second preferred embodiment of the present invention. In the second embodiment, the same parts as the first embodiment will not be described.

As shown in the drawings, in the second preferred embodiment, upper and lower header tanks 210 and 220 are respectively mounted on the upper and lower portions of the heat exchanger. The header tanks 210 and 220 respectively include: upper and lower headers 211 and 221 having a number of tube insertion slots 211*a* and 221*a* of plural arrays which are coupled with both ends of a number of tubes 230 arranged in plural rows at intervals in an air-flow direction, and fixing means 213 and 223 disposed at both width-direction end portions thereof; and upper and lower tanks 212 and 222 respectively seated on the headers 211 and 221, fixed on the headers 211 and 221 via the fixing means 213 and 223, and having domes 212*a* and 222*a* protruding in an insertion direction of the tubes 230.

Connection members 215 and 225 are respectively interposed between the headers 211 and 221 and the tanks 212 and 222. The connection members 215 and 225 respectively include a number of insertion slots 216 and 226 of plural arrays for inserting end portions of the tubes 230 of the plural arrays thereinto, and connection flow channels 217*a*, 217*b* and 227*a*, 227*b* formed in plural rows for independently intercommunicating the tubes 130 of each array by connecting the insertion slots 216 and 226 with one another.

As described above, the first preferred embodiment shows a single array tube structure, but the second preferred embodiment show a multiple array tube structure in which the arrays of the tubes 230 are extended in the air flow direction. However, there is no difference except that the tubes are formed in a single array and in the multiple arrays.

However, the second preferred embodiment needs a structure for communicating a front tube array 202 with a rear tube array 201 to form various refrigerant flow channels since the second embodiment has the multiple array tube structure. Of course, it is possible to form the refrigerant flow channel even though the front tube array 202 and the rear tube array 201 are not communicated with each other.

Therefore, the present invention has communication means 228 for communicating the connection flow channels 227*a* and 227*b* with each other.

The communication means 228 includes a communication passageway 228*a* formed on one of the connection members 215 and 225 for communicating the connection flow channels 227*a* and 227*b* with each other, and a partition wall 228*b* formed between the insertion slots 226 for closing the connection flow channels 227*a* and 227*b*.

Moreover, alternatively, the communication means 228 may have a communication passageway 222*b* formed on one of the tanks 212 and 222 for communicating the domes 222*a* of the plural arrays with each other.

Here, the communication passageways 228*a* and 22*b* may have different sizes and widths in consideration of heat exchange efficiency. Additionally, in the drawings, the communication passageways 228*a* and 222*b* communicate the connection flow channels 227*a* and 227*b* of the plural arrays with each other or the domes 222*a* of the plural arrays with each other in the width direction. However, in order to reduce refrigerant flow resistance, additional communication passageway (not shown) for communicating the insertion slots 226 or the domes 222*a* of each array in the communication passageways 227*a* and 227*b* of the plural arrays or the domes 222*a* of the plural arrays may be formed in the length direction.

In the present invention, the communication means 228 is formed on the lower connection member 225 or the lower tank 222, and therefore, the second embodiment has a refrigerant flow channel where refrigerant flowing through the rear tube array 201 is returned at the lower header tank 220 having the communication means 228, flows through the front tube array 202, and then, is discharged to the outside.

Moreover, end caps 250 are coupled to both end portions of the header tanks 210 and 220, and have inlet and outlet pipes 260 and 261. The position of the inlet and outlet pipes 260 and 261 is determined according to the configuration of the refrigerant flow channel. In this embodiment, the inlet pipe 260 and the outlet pipe 261 are formed at a side of the upper header tank 210. At this time, the inlet pipe 260 is communicated with the rear tube array 201 through the connection flow channel 217*a* placed at the rear side of the upper header tank 210, and the outlet pipe 261 is communicated with the front tube array 202 through the connection flow channel 217*b* placed at the front side of the upper header tank 210.

Furthermore, an inlet flow channel 218*a* for communicating the inlet pipe 260 with the rear side connection flow channel 217*a* and an outlet flow channel 218*b* for communicating the outlet pipe 261 with the front side connection flow channel 217*b* are respectively formed at an end portion of the upper connection member 215.

A refrigerant circulation process of the heat exchanger according to the second preferred embodiment of the present invention will be described as follows.

First, when refrigerant is supplied through the inlet pipe 260, refrigerant is induced into the rear side connection flow channel 217*a* communicating with the rear tube array 201 through the inlet flow channel 218*a* of the upper connection member 215. Here, when refrigerant is induced into the rear side connection flow channel 217*a*, refrigerant is supplied to the end portions of the rear tube array 201 through the rear side domes 212*a* of the upper tank 212.

Continuously, refrigerant induced into the rear side connection flow channel 217*a* flows along the tubes 230 of the rear tube array 201, and at this time, exchanges heat with the outside air passing through the tubes 230 during the process that refrigerant flows through the tubes 230. After that, refrigerant flows into the rear side connection flow channel 227*a* of the lower connection member 225 through the rear side domes 222*a* of the lower tank 222.

Refrigerant flown into the rear side connection flow channel 227*a* of the lower connection member 225 flows into the front side connection flow channel 227*b* of the lower connection member 225 through the communication path 228, and then, flows along the tubes 230 of the front tube array 202. At this time, refrigerant re-exchanges heat with the outside air passing through the tubes 230, and then, is induced into the front side connection flow channel 217*b* of the upper connection member 215.

Refrigerant induced into the front side connection flow channel 217*b* of the upper connection member 215 is discharged to the outlet pipe 261 through the outlet flow channel 218*b* formed at the end portion of the connection member 215.

Figure 12:
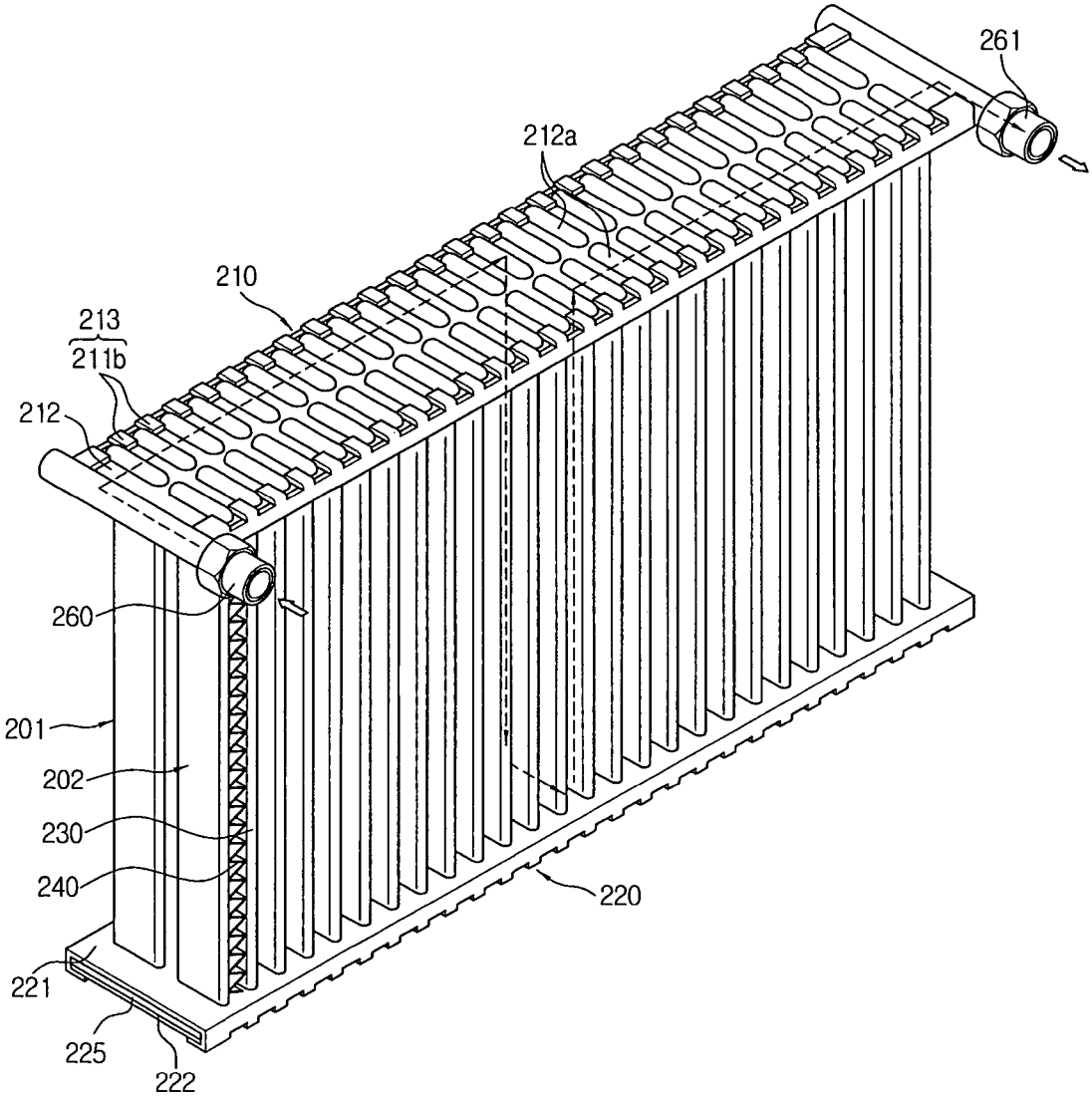
FIG. 12 is a perspective view of a heat exchanger according to a third preferred embodiment of the present invention.

FIG. 12 is a perspective view of a heat exchanger according to a third preferred embodiment of the present invention. In the third embodiment, the same parts as the second embodiment will not be described.

As shown in the drawing, the third preferred embodiment has the same structure as the second preferred embodiment, but the inlet and outlet pipes 260 and 261 are selectively formed at both end portions of the tanks 212 and 222 and the upper and lower headers 211 and 221 in such a way as to be directed forward.

That is, in FIG. 12, the inlet and outlet pipes 260 and 261 are mounted at both end portions of the upper header tank 210, and at this time, the inlet pipe 260 is communicated with the rear side connection flow channel 217*a* of the upper connection member 215, and the outlet pipe 261 is communicated with the rear side connection flow channel 217*b* of the upper connection member 215.

Meanwhile, the inlet and outlet pipes 260 and 261 may be mounted not at the both end portions of the upper header tank 210 but at a predetermined position between the both end portions of the header tank 210 freely.

As described above, the refrigerant flow channels described in the first and second preferred embodiments are just examples, and can be configured in various ways through various modifications of the baffle 119 or the communication means 228 formed on the connection members 115 and 125 or 215 and 225.

Furthermore, in the present invention, the tubes 130 or 230 are arranged in a row or two rows, but it would be appreciated that they can be arranged in more than two rows.

As described above, the present invention includes the headers, the tanks having a number of the domes and coupled with the headers, and the connection members respectively interposed between each header and each tank and having the connection flow channel, therefore reducing the volume of the header tank, improving productivity, and easily changing the refrigerant flow channel by simply forming the baffle or the communication means on the connection member.

Moreover, the present invention improved pressure resistance and durability by interposing the connection member between the header and the dome type tank to widen the contact area therebetween.

Additionally, the tubes are arranged in multiple rows, and the connection flow channels of the connection members are easily intercommunicated via the communication means so as to communicate the plural tubes, whereby the heat exchanger according to the present invention can reduce a temperature differences in all directions since refrigerant can flow smoothly.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heat exchanger comprising:

upper and lower headers having a number of tube insertion slots coupled with both end portions of a number of tubes arranged at intervals;

upper and lower tanks respectively seated on the upper and lower headers and having domes protruding in an insertion direction of the tubes, the domes have sections for surrounding an end portion of each tube in correspondence of the end portion of each tube; and upper and lower connection members respectively interposed between the headers and the tanks, and having a number of insertion slots for inserting end portions of the tubes thereinto and connection flow channels for communicating the tubes with one another by connecting the insertion slots with one another.

2. A heat exchanger according to claim 1, wherein the tubes are arranged in multiple arrays in an air flow direction.

3. A heat exchanger according to claim 1, wherein the upper and lower headers include fixing means for fixing the upper and lower tanks.

4. A heat exchanger according to claim 3, wherein the fixing means have a number of protruding taps formed in a length direction of the headers for fixing both end portions of the tanks.

5. A heat exchanger according to claim 1, wherein the connection member has baffles for closing a specific portion of the connection flow channel for allowing refrigerant to flow through the tubes in a zigzag form.

6. A heat exchanger according to claim 2, further comprising communication means for communicating the connection flow channels with each other so as to communicate the tubes of the multiple arrays.

7. A heat exchanger according to claim 6, wherein the communication means includes a communication passageway formed on the upper connection member or the lower connection member for intercommunicating the connection flow channels and of the multiple arrays, and a partition wall formed between the insertion slots for closing the connection flow channels.

8. A heat exchanger according to claim 6, wherein the communication means includes a communication passageway formed on the upper tank or the lower tank for communicating the plural domes with one another.

9. A heat exchanger according to claim 1, wherein a number of the connection members are laminated on one another.

10. A heat exchanger according to claim 9, the connection flow channels of the connection members are different in size from each other.

11. A heat exchanger according to claim 1, wherein end caps are respectively coupled to end portions of the upper and lower headers and the upper and lower tanks, and respectively have inlet pipes and outlet pipes selectively formed thereon.

12. A heat exchanger according to claim 11, wherein the connection members respectively have inlet and outlet flow channels formed at end portions thereof for respectively communicating the connection flow channels with the inlet pipes and outlet pipes.

13. A heat exchanger according to claim 1, wherein the inlet pipes and the outlet pipes are selectively formed at both end portions of the upper and lower headers and the upper and lower tanks in such a way as to be directed forward.

14. A heat exchanger according to claim 2, wherein the upper and lower headers include fixing means for fixing the upper and lower tanks.

15. A heat exchanger according to claim 2, wherein a number of the connection members are laminated on one another.

16. A heat exchanger according to claim 2, wherein end caps are respectively coupled to end portions of the upper and lower headers and the upper and lower tanks, and respectively have inlet pipes and outlet pipes selectively formed thereon.

17. A heat exchanger according to claim 2, wherein the inlet pipes and the outlet pipes are selectively formed at both end portions of the upper and lower headers and the upper and lower tanks in such a way as to be directed forward.

18. A heat exchanger according to claim 15, the connection flow channels of the connection members are different in size from each other.

19. A heat exchanger according to claim 14, wherein the fixing means have a number of protruding taps formed in a length direction of the headers for fixing both end portions of the tanks.

20. A heat exchanger according to claim 16, wherein the connection members respectively have inlet and outlet flow channels formed at end portions thereof for respectively communicating the connection flow channels with the inlet pipes and outlet pipes.

* * * * *

UNITED STATES PATENT AND TRADEMARK OFFICE

CERTIFICATE OF CORRECTION

PATENT NO. : 7,637,314 B2
APPLICATION NO. : 11/342043
DATED : December 29, 2009
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1009 days.

Signed and Sealed this

Ninth Day of November, 2010

David J. Kappos

David J. Kappos
*Director of the United States Patent and Trademark Office*